US012715566B2

(12) United States Patent
Ooshita

(10) Patent No.: US 12,715,566 B2
(45) Date of Patent: Aug. 25, 2026

(54) ENGINE CONTROL APPARATUS

(71) Applicant: NHK SPRING CO., LTD., Yokohama (JP)

(72) Inventor: Sachio Ooshita, Yokohama (JP)

(73) Assignee: NHK SPRING CO., LTD., Kanagawa (JP)

( * ) Notice: Subject to any disclaimer, the term of this patent is extended or adjusted under 35 U.S.C. 154(b) by 268 days.

(21) Appl. No.: 18/669,575

(22) Filed: May 21, 2024

(65) Prior Publication Data

US 2024/0308636 A1 Sep. 19, 2024

Related U.S. Application Data

(63) Continuation of application No. PCT/JP2022/039236, filed on Oct. 21, 2022.

(30) Foreign Application Priority Data

Nov. 22, 2021 (JP) ..... 2021-189476

(51) Int. Cl.
*B63H 20/12* (2006.01)
*B63H 21/21* (2006.01)

(52) U.S. Cl.
CPC ..... *B63H 20/12* (2013.01); *B63H 21/213* (2013.01)

(58) Field of Classification Search
CPC ..... B63H 20/12; B63H 21/213; B63H 2021/216; B63H 2025/024; F16H 2059/0295; F16H 2061/326; F16H 59/105; F16H 61/32
See application file for complete search history.

(56) References Cited

U.S. PATENT DOCUMENTS 5,222,901 A 6/1993 Burkenpas
7,442,104 B2 * 10/2008 Okabe ..... B63H 20/08 74/480 B
9,789,945 B1 * 10/2017 Vaninetti ..... B63H 20/12
(Continued)

FOREIGN PATENT DOCUMENTS

JP H062575 A 1/1994
JP 2007298093 A 11/2007
(Continued)

OTHER PUBLICATIONS

International Search Report (ISR) (and English language translation thereof) and Written Opinion dated Nov. 29, 2022, issued in International Application No. PCT/JP2022/039236.

*Primary Examiner* — Andrew Polay
(74) *Attorney, Agent, or Firm* — Holtz, Holtz & Volek PC

(57) ABSTRACT

An engine control apparatus includes a lever member, an input shaft, a potentiometer, an output gear, a motor, a shift arm, a reduction gear mechanism, and a force transmission mechanism. The force transmission mechanism includes a damper unit. When the lever member moves in a first direction or a second direction, the motor rotates based on an output of the potentiometer. The rotation of the motor is transmitted to the shift arm via the reduction gear mechanism. This moves the shift arm to a forward-side shift positon or a backward-side shift position. When the lever member is located within a predetermined angle from the neutral position, the damper unit deforms in a state where the output gear stops. This allows the rotation of the input axis.

6 Claims, 11 Drawing Sheets

(56) References Cited

U.S. PATENT DOCUMENTS

| | | | | |
|---|---|---|---|---|
| 10,279,881 | B2 * | 5/2019 | Matsuyama | F02D 11/04 |
| 10,696,367 | B1 * | 6/2020 | Ingebritson | B63H 20/12 |
| 2007/0254540 | A1 | 11/2007 | Miyashita et al. | |

FOREIGN PATENT DOCUMENTS

| | | | |
|---|---|---|---|
| JP | 2012101793 | A | 5/2012 |
| JP | 2019001209 | A | 1/2019 |

* cited by examiner

ENGINE CONTROL APPARATUS

CROSS-REFERENCE TO RELATED APPLICATIONS

This application is a Continuation Application of PCT Application No. PCT/JP2022/039236, filed Oct. 21, 2022 and based upon and claiming the benefits of priority from prior Japanese Patent Application No. 2021-189476, filed Nov. 22, 2021, the entire contents of all of which are incorporated herein by reference.

BACKGROUND OF THE INVENTION

1. Field of the Invention

The present invention relates to an engine control apparatus comprising a lever member for operating an engine and relates to a tiller handle of, for example, an outboard motor.

2. Description of the Related Art

As described in Patent Literature 1 (JP 2019-1209 A) and Patent Literature 2 (JP 2012-101793 A), an outboard motor comprising a tiller handle has known. The tiller handle is operated by an operator. It is known to provide an operation portion for throttle and a lever member for shift on the tiller handle. It is possible to increase or decrease engine speed by operating the operation portion for throttle. A shift mechanism of the outboard motor is switched to a forward-side shift position by moving the lever member for shift to a forward position. The shift mechanism is switched to a backward-side shift position by moving the lever member to a backward position. The shift mechanism of the outboard is an example of a machine to be controlled.

It is common to use a force transmission member such as a push-pull cable in a tiller handle comprising a lever member for shift operation to transmit force of the lever member to the shift mechanism of an engine. A push cable is moved by operating the lever member to the forward position or the backward position. This switches the shift mechanism of the engine to the forward-side shift position or the backward-side shift position.

In outboard motors in Patent Literatures 1 and 2, a movement of an operation portion is transmitted to an engine by a mechanical force transmission member. In that case, a movement of the operation portion is restricted in a case where a frictional resistance is large when the force transmission member moves. Therefore, the operation portion cannot be easily operated in some cases.

It is conceived to electrically detect the movement of the operation portion of the lever member and the like. The force transmission member moves by an actuator of motors and the like driving based on a detected electric output. For example, a torque sensor is provided on a tiller handle. The force transmission member can be moved by actuating the actuator of motors and the like based on the output from the torque sensor.

The electric detection of the operation portion by using the torque sensor involves complicated control system and increases cost. In addition, the electric detection has concerns that the shift operation cannot be achieved when the actuator is inoperative due to electrical system malfunction and the like.

BRIEF SUMMARY OF THE INVENTION

An object of an embodiment is to provide an engine control apparatus capable of assisting the shift operation using motor output. The embodiment provides the engine control apparatus capable of controlling start and stop of the motor irrespective of electric signals of the torque sensors and the like and performing the shift operation irrespective of the electrical system malfunction.

An engine control apparatus of an embodiment comprises a base member, a lever member for shift operation, an output gear, a motor, a potentiometer, a shift arm, a reduction gear mechanism, and a force transmission mechanism. The lever member rotates about an input shaft provided on the base member. The lever member moves from a neutral position in a first direction and a second direction. The output gear is provided on the input shaft. The output gear is capable of relatively rotating about the input shaft.

The motor rotates in a first rotational direction and a second rotational direction.

When the lever member moves by a predetermined angle in the first direction, the potentiometer outputs a signal causing the motor to rotate in the first rotational direction. When the lever member moves by a predetermined angle in the second direction, the potentiometer outputs a signal causing the motor to rotate in the second rotational direction. The shift arm turns around a shift arm shaft provided on the base member. A shift arm driving gear provided on the shift arm shaft engages with the output gear. The reduction gear mechanism transmits rotation of the motor to the shift arm driving gear.

The force transmission mechanism includes a dumber unit. The damper unit is provided between the input shaft and the output gear. An operator operates the lever member. When the lever member moves by a predetermined angle or less from the neutral position, the damper unit deforms. Thus, rotation of the input shaft is allowed in a state where the output gear stops. When the lever member moves by more than the predetermined angle, the rotation of the input shaft is transmitted to the output gear via the damper unit. The output gear rotates and causes the shift arm driving gear to rotate. Thus, the shift arm moves to a forward-side shift position or a backward-side shift position.

An engine control apparatus of an embodiment can assist shift operation using torque of motor. In addition, start and stop of the motor can be controlled without a torque sensor and the shift operation can be performed even an electrical system malfunction occurs.

An example of the damper unit may include a driving side rotor, a pin, and an elastic member. The driving side rotor rotates together with the input shaft. The pin is provided on the output gear or the driving side rotor. The elastic member is pressed by the pin to deform in a state where the input shaft rotates in the first direction. In addition, the elastic member is pressed by the pin to deform in a state where the input shaft rotates in the second direction.

The damper unit preferably includes a first stopper and a second stopper. The first stop per prevents the driving side rotor from relatively rotating at a first angle or more with respect to the output gear in a state where the driving side rotor rotates in the first direction and the elastic member deforms. The second stopper prevents the driving side rotor from relatively rotating at a second angle or more with respect to the output gear in a state where the driving side rotor rotates in the second direction and the elastic member deforms.

The elastic member may include a first elastic body and a second elastic body. The first elastic body is arranged to be opposed to a side surface of the pin. The first elastic body is compressed by the pin in a state where the input shaft rotates in the first direction. The second elastic body is arranged to be opposed to other side surface of the pin. The second elastic body is compressed by the pin in a state where the input shaft rotates in the second direction.

An example of the reduction gear mechanism includes a plurality of spur gears. With the motor being in a non-energized state, torque input from the lever member to the input shaft is transmitted to the output gear via the force transmission mechanism. The torque may cause the shift arm driving gear and the shift arm to rotate. The motor may be driven to rotate by the torque input to the input shaft being transmitted to the motor via the reduction gear mechanism.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

First Embodiment

An engine control apparatus of a first embodiment will be described with reference to FIG. 1 to FIG. 11.

Figure 1:
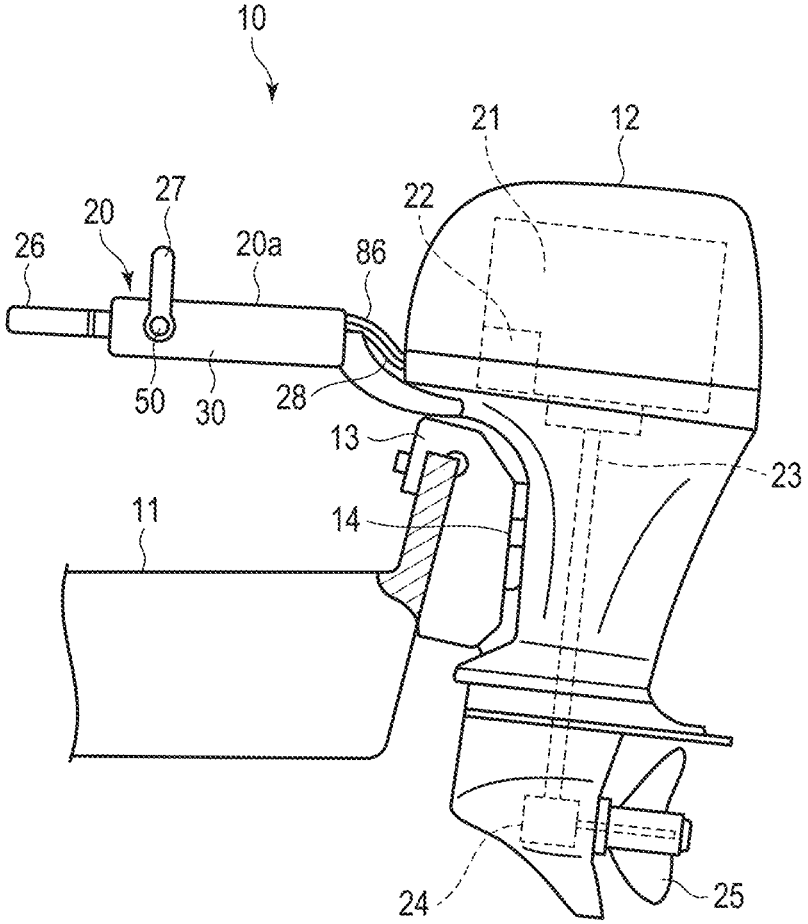
FIG. 1 is a side view showing a part of a small boat comprising an outboard motor.

A small boat 10 partially shown in FIG. 1 comprises an outboard motor 12 mounted in the rear of a hull 11. The outboard motor 12 is fixed to the hull 11 by a fixing mechanism 13. The outboard motor 12 can change its direction to right or left from a hinge portion 14 serving as a center. A tiller handle 20 for steering is provided on the outboard motor 12. The direction of the outboard motor 12 can be changed by operating the tiller handle 20.

An engine 21, a throttle mechanism 22, a moving force transmission mechanism 23, and a shift mechanism 24 are provided in the outboard motor 12. The rotation of the engine 21 is transmitted to a propeller 25 via the moving force transmission mechanism 23 and the shift mechanism 24. The shift mechanism 24 has a function of switching the rotational direction of the propeller 25. The shift mechanism 24 is an example of a machine to be controlled. A throttle operation member 26 for operating the throttle mechanism 22 and a lever member (shift lever) 27 for operating the shift mechanism 24 are provided on the tiller handle 20. The throttle operation member 26 is connected to the throttle mechanism 22 through a throttle cable 28.

Figure 2:
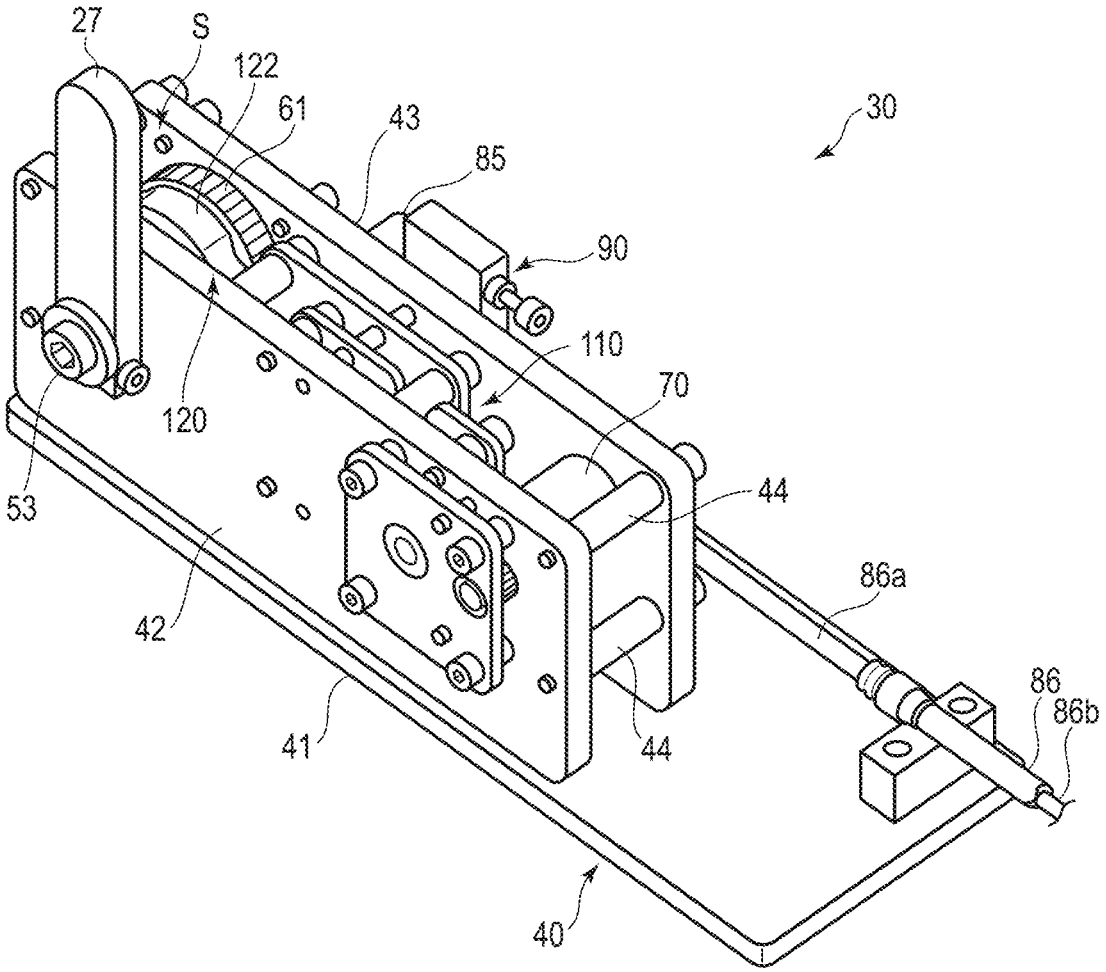
FIG. 2 is a perspective view showing an engine control apparatus, a cover of which is detached, of a first embodiment.
Figure 3:
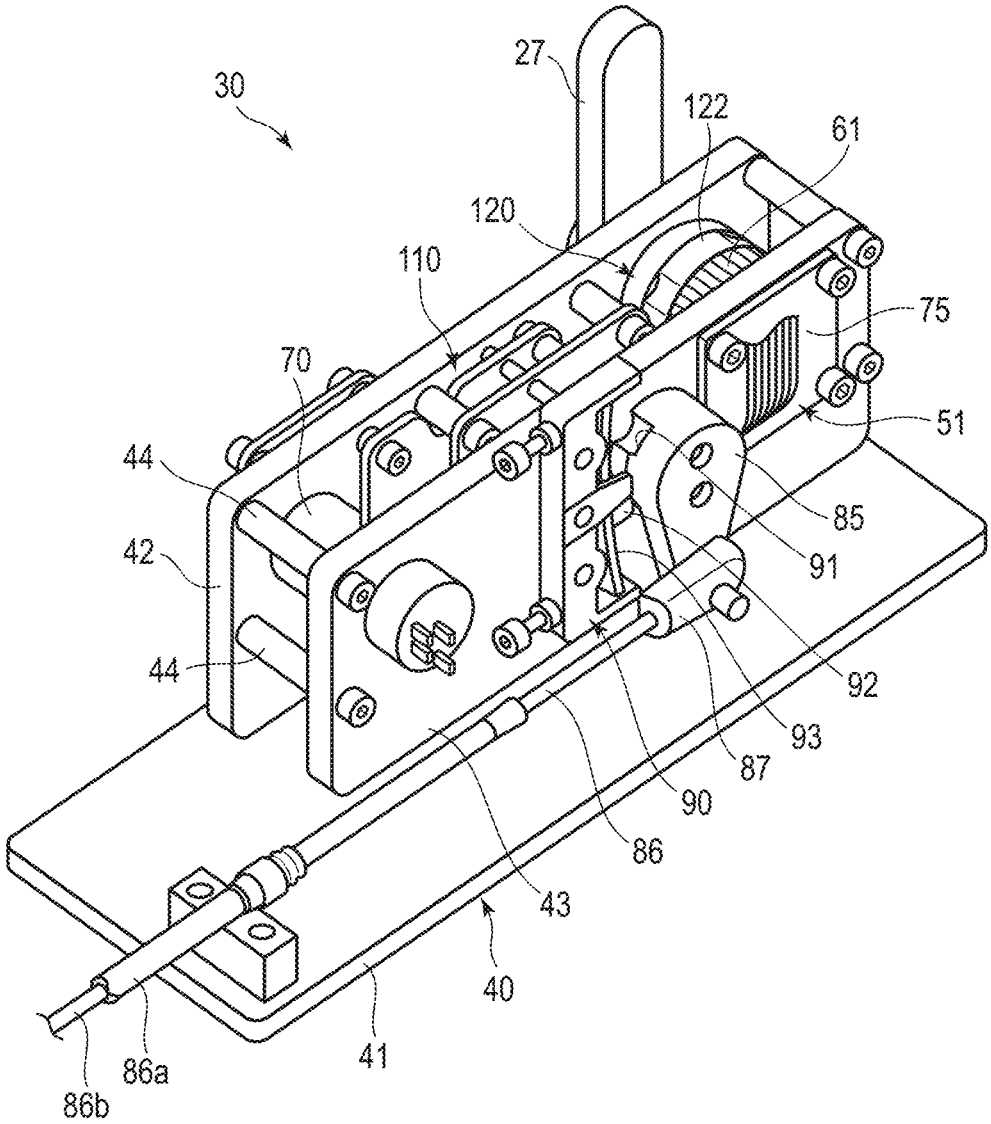
FIG. 3 is a perspective view showing the engine control apparatus shown in FIG. 2 from a side opposite to FIG. 2.
Figure 4:
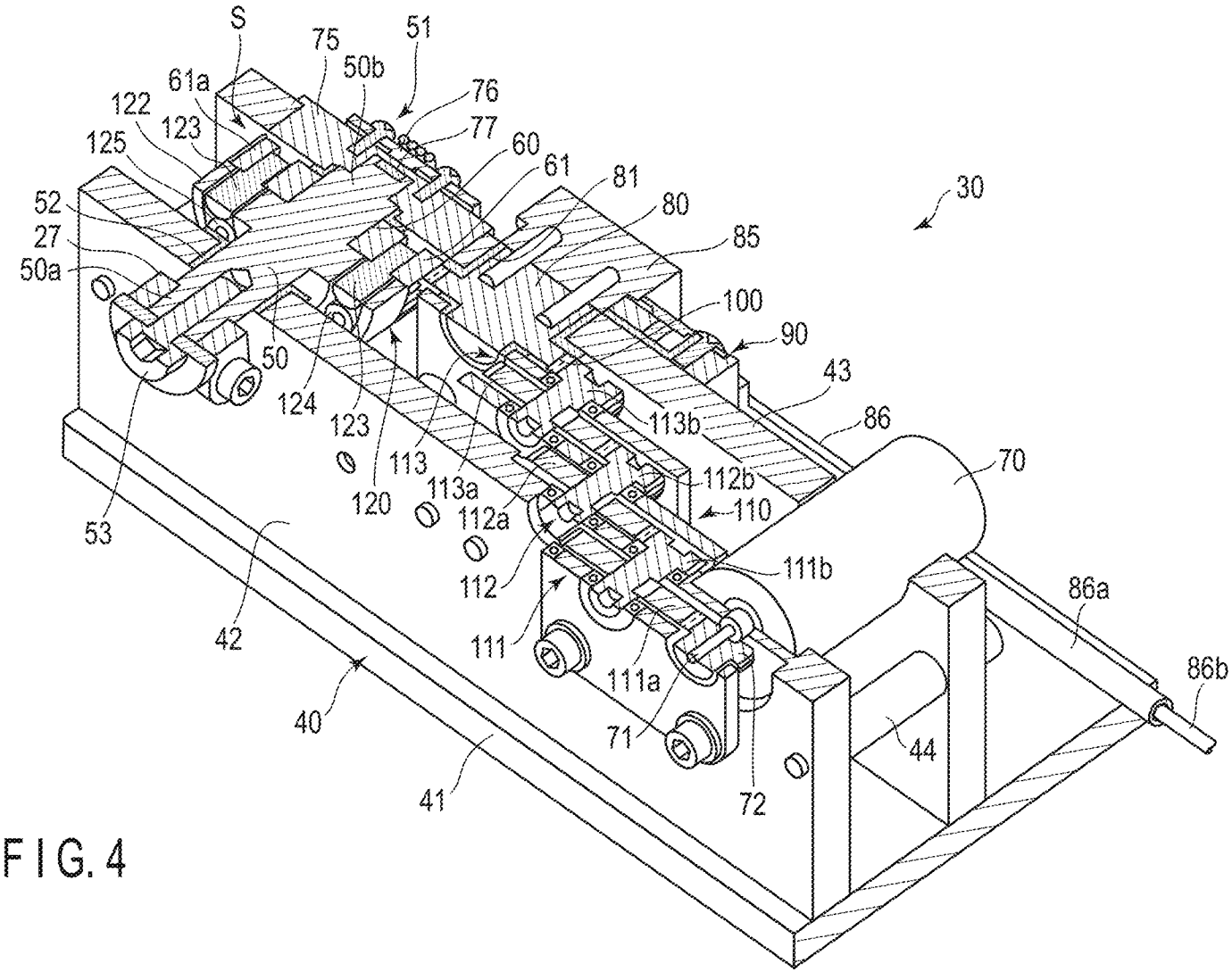
FIG. 4 is a cross-sectional perspective view showing a part of the engine control apparatus.

The tiller handle 20 of the present embodiment comprises an engine control apparatus 30. FIG. 2 is a schematic perspective view showing the engine control apparatus 30 in a state where a cover 20*a* (shown in FIG. 1) of the tiller handle 20 is detached. FIG. 3 is a perspective view showing the engine control apparatus 30 from a side opposite to FIG. 2. FIG. 4 is a perspective view showing a part of the engine control apparatus 30 in cross-section along a horizontal direction.

The engine control apparatus 30 comprises a base member 40. The shape of the base member 40 is not specifically limited, and includes a base body 41 and a pair of frame members 42 and 43 provided on the base body 41, for example. The frame members 42 and 43 are opposed to each other with gaps and are fixed to each other by a fastening member 44 such as a bolt.

As shown in FIG. 4, an input shaft 50 and a potentiometer 51 are provided on the base member 40. The potentiometer 51 will be described later. The input shaft 50 is rotatably supported by a bearing member 52 provided on the frame member 42. A first end portion 50*a* of the input shaft 50 is located outside the frame member 42. The lever member 27 for shift operation is attached to the first end portion 50*a* of the input shaft 50 by a fixing member 53. The lever member 27 can rotate about the input shaft 50.

Figure 5:
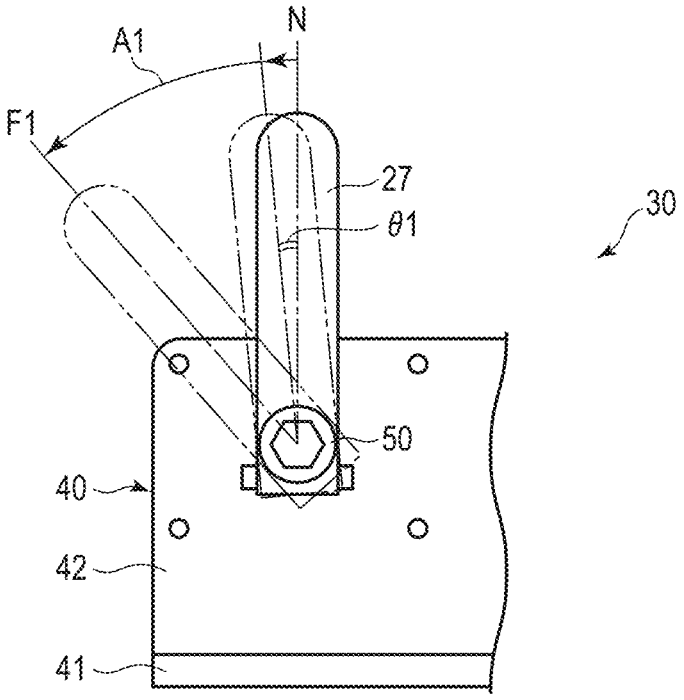
FIG. 5 is a side view showing a state where a lever member of the engine control apparatus moves from a neutral position to a first direction.
Figure 6:
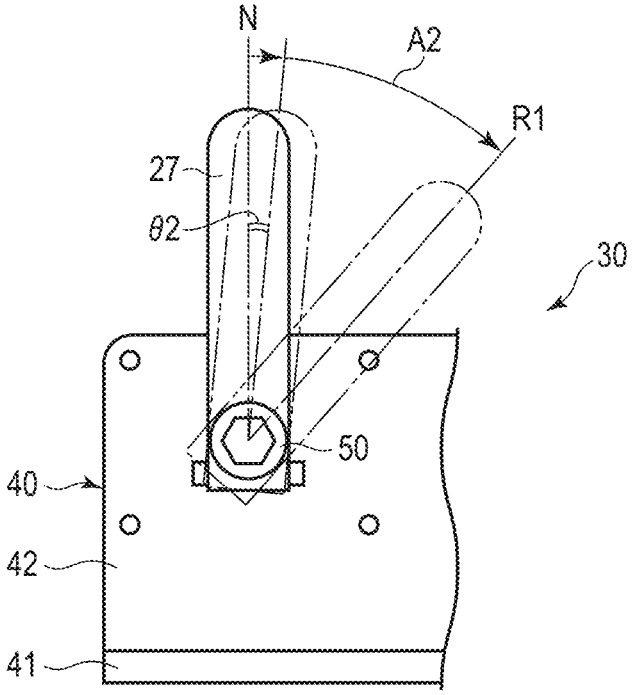
FIG. 6 is a side view showing a state where the lever member of the engine control apparatus moves from the neutral position to a second direction.

FIG. 5 is a side view showing a state where the lever member 27 moves from a neutral position N to a first direction A1 (forward side). FIG. 6 is a side view showing a state where the lever member 27 moves from the neutral position N to a second direction A2 (backward side). The lever member 27 can move from the neutral position N in the first direction A1 and the second direction A2 by a hand of an operator.

Figure 7:
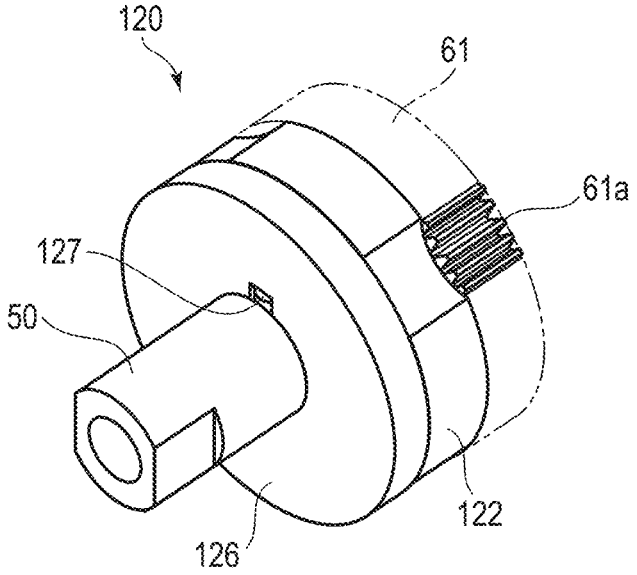
FIG. 7 is a perspective view showing a force transmission mechanism of the engine control apparatus.
Figure 8:
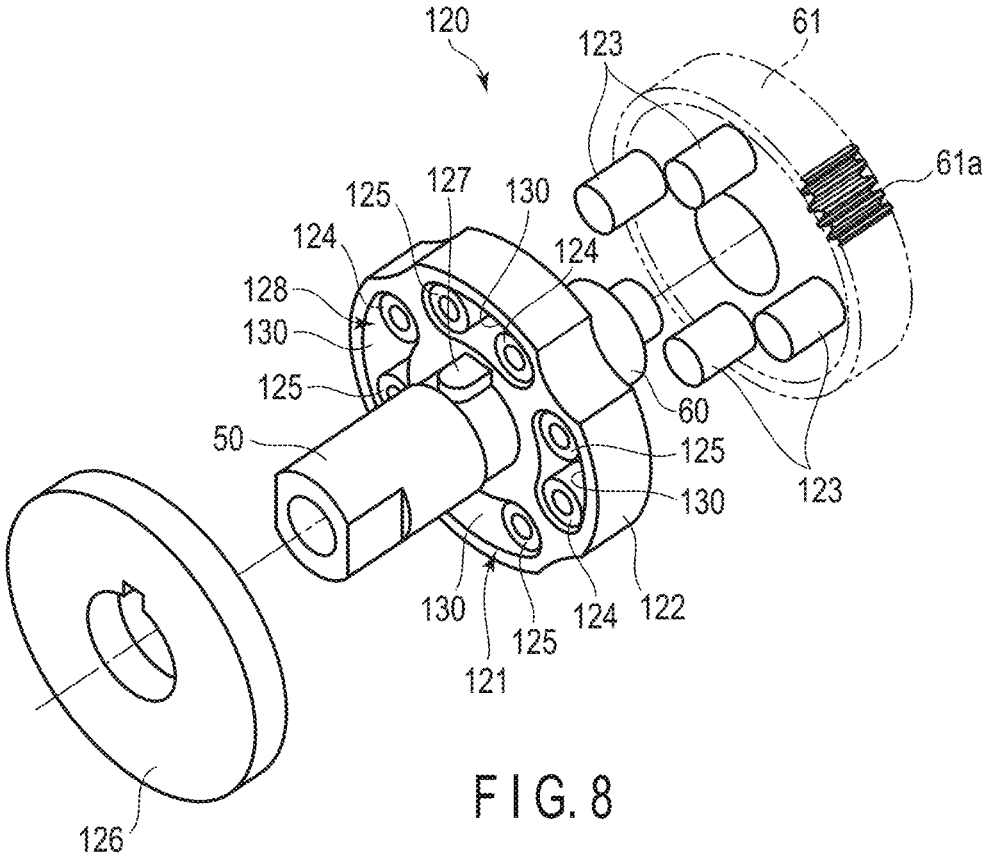
FIG. 8 is a schematic exploded perspective view showing the force transmission mechanism shown in FIG. 7.

A column shaped gear holding portion 60 (shown in FIG. 4) is provided on a part of the input shaft 50 in the length direction. The gear holding portion 60 is arranged in a space S inside the frame members 42 and 43. An output gear 61 (shown in FIG. 4, FIG. 7, and FIG. 8) is provided on the gear holding portion 60. The output gear 61 can relatively rotate about the input shaft 50 with respect to the input shaft 50. A gear portion 61*a* is formed to be continuous all around the output gear 61. For the sake of making figures simple, FIG. 7 and FIG. 8 show a part of the gear portion 61*a*.

A motor 70 is arranged on the base member 40. A gear 72 is provided on an output shaft 71 of the motor 70 (shown in FIG. 4). The motor 70 can rotate by direct current in the first rotational direction and the second rotational direction opposite to the first rotational direction. In other words, the motor 70 can perform forward/backward rotation. A driving source of the motor 70 is a battery mounted on the hull 11.

The potentiometer 51 is provided on the base member 40. The potentiometer 51 includes s support member 75, a potentiometer substrate 76, and the like. The support member 75 is fixed to the frame member 43. The potentiometer substrate 76 is fixed to the support member 75. A magnet 77 is provided on a second end portion 50*b* of the input shaft 50. An element provided on the potentiometer substrate 76 reacts to magnetism of the magnet 77. Thus, the position of the rotational direction of the input shaft 50 (angle with respect to a reference position) can be detected.

The lever member 27 rotates in the first direction A1 (shown in FIG. 5) and the second direction A2 (shown in FIG. 6). When the lever member 27 moves by a first angle θ1 in the first direction A1, the potentiometer 51 outputs a first signal causing the motor 70 to rotate in the first rotational direction. When the lever member 27 moves to a forward-side position F1, a signal to stop the motor 70 is output.

When the lever member 27 moves by a second angle θ2 in the second direction A2, the potentiometer 51 outputs a second signal causing the motor 70 to rotate in the second rotational direction. When the lever member 27 moves to a backward-side position R1, a signal to stop the motor 70 is output.

A shift arm shaft 80 (shown in FIG. 4) is provided on the base member 40. The shift arm shaft 80 is rotatably supported by a bearing member 81 provided on the frame member 43. A shift arm 85 (shown in FIG. 3 and FIG. 4) is provided on the shift arm shaft 80. The shift arm 85 rotates forward/backward direction from the shift arm shaft 80 serving as the center of the rotation. The shift arm 85 moves to the forward-side shift position and the backward-side shift position from the neutral position.

As shown in FIG. 3, an end of a shift cable 86 is connected to the shift arm 85 through a connecting member 87. The other end of the shift cable 86 is connected to the shift mechanism 24 of the outboard motor 12 (shown in FIG. 1). As an example, the shift cable 86 is a push-pull cable including an outer tube 86*a*, an inner cable 86*b*, and the like. The shift mechanism 24 is operated when the shift cable 86 is pushed or pulled by the shift arm 85.

The engine control apparatus 30 of the present embodiment includes a detent mechanism 90 (partially shown in FIG. 3 and FIG. 4). The detent mechanism 90 can hold the shift arm 85 at the neutral position, the forward-side shift position, and the backward-side shift position. As an example, the detent mechanism 90 includes a plurality of recesses 91 (partially shown in FIG. 3), a brake member 92 such as a ball, and a spring 93. For example, three recesses 91 are formed in a circumferential direction of a base of the shift arm 85. The brake member 92 can engage with any of three recesses 91. The spring 93 urges the brake member 92. The three recesses 91 are formed on positions for making the shift arm 85 stop at any of the neutral position, the forward-side shift position, and the backward-side shift position.

As shown in FIG. 4, a shift arm driving gear 100 is provided on the shift arm shaft 80. The shift arm driving gear 100 engages with the output gear 61. The output gear 61 rotates and causes the shift arm driving gear 100 to rotate according the rotational direction of the output gear 61. Thus, the shift arm 85 moves to the forward-side shift position or the backward-side shift position.

The gear 72 is provided on the output shaft 71 of the motor 70. A reduction gear mechanism 110 is arranged between the gear 72 and the shift arm driving gear 100. The rotation of the motor 70 is transmitted to the shift arm driving gear 100 via the reduction gear mechanism 110. As an example, the reduction gear mechanism 110 includes a first gear unit 111, a second gear unit 112, and a third gear unit 113. The configuration of the reduction gear mechanism 110 is not limited to that of the present embodiment. In other words, the reduction gear mechanism 110 comprises any configurations in which the rotation speed of the motor 70 is reduced and torque is increased and transmitted to the shift arm driving gear 100.

The first gear unit 111 includes a large diameter gear 111*a* and a small diameter gear 111*b*. The large diameter gear 111*a* engages with the gear 72 of the motor 70. The second gear unit 112 includes a large diameter gear 112*a* and a smaller diameter gear 112*b*. The large diameter gear 112*a* engages with the small diameter gear 111*b* of the first gear unit 111. The third gear unit 113 includes a large diameter gear 113*a* and a small diameter gear 113*b*. The large diameter gear 113*a* engages with the small diameter gear 112*b* of the second gear unit 112. The small diameter gear 113*b* of the third gear unit 113 engages with the shift arm driving gear 100. Therefore, the rotation speed of the motor 70 is reduced by the reduction gear mechanism 110, and the rotation of the motor 70 is transmitted to the shift arm driving gear 100.

The reduction gear mechanism 110 includes a plurality of gears 111*a*, 111*b*, 112*a*, 113*a*, and 113*b*. These gears 111*a*, 111*b*, 112*a*, 112*b*, 113*a*, and 113*b* all are spur gears. The gear 72 of the motor 70 and the shift arm driving gear 100 are spur gears as well. Therefore, if the motor 70 becomes non-energized state due to power supply trouble and the like, torque input to the lever member 27 can be transmitted to the shift arm driving gear 100. In addition, torque input to the lever member 27 can be transmitted to the motor 70 via the reduction gear mechanism 110 as well. Therefore, even if electrical outage occurs, the motor 70 can be forcibly driven to rotate by manual torque input to the lever member 27. The shift arm 85 can be moved to the forward-side shift position or the backward-side shift position.

Figure 9:
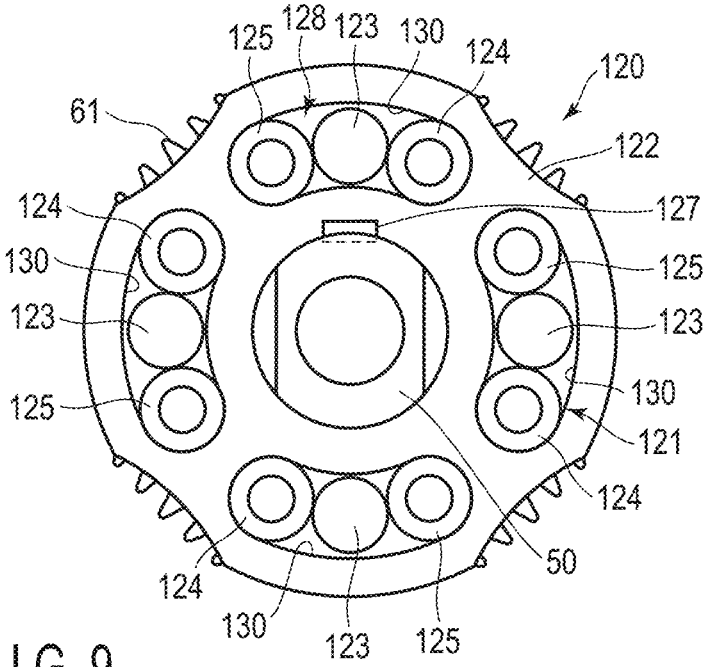
FIG. 9 is a front view of the force transmission mechanism shown in FIG. 7.

As shown in FIG. 7 and FIG. 8, a force transmission mechanism 120 is provided on the input shaft 50. The force transmission mechanism 120 includes a damper unit 121. FIG. 7 is a perspective view of the force transmission mechanism 120. FIG. 8 is an exploded perspective view of the force transmission mechanism 120. FIG. 9 is a front view of the damper unit 121.

As an example, the damper unit 121 includes a driving side rotor 122, a plurality (for example, four) of pins 123, a first elastic body 124, a second elastic body 125, and a lid member 126. The driving side rotor 122 rotates together with the input shaft 50. The pin 123 is provided on the output gear 61. The driving side rotor 122 and the lid member 126 are coupled with each other by a rotation prevention member 127. The driving side rotor 122 and the lid member 126 rotate together with the input shaft 50. An elastic member 128 is constituted by the first elastic body 124 and the second elastic body 125.

Figure 10:
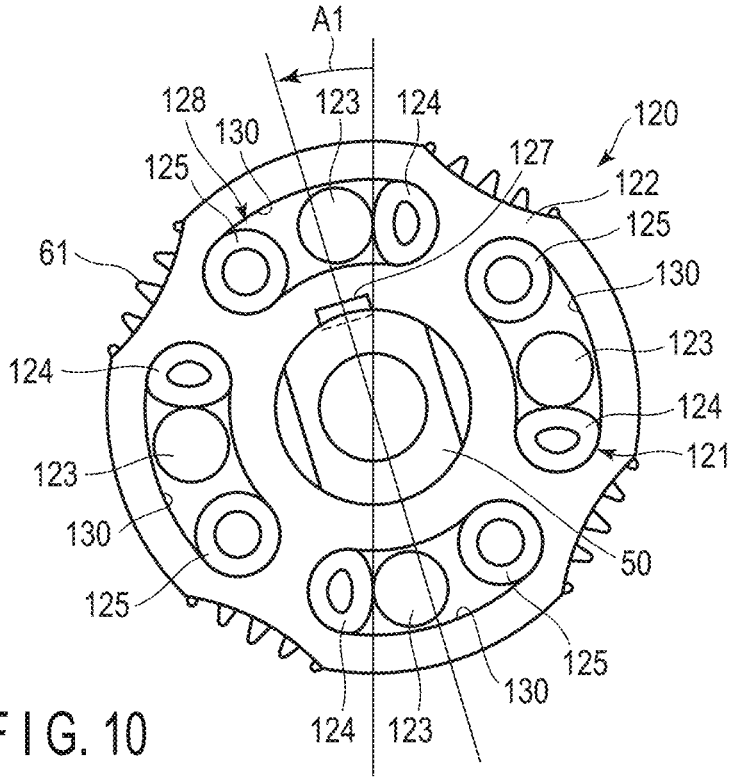
FIG. 10 is a front view showing a state where a driving side rotor of the force transmission mechanism shown in FIG. 9 rotates in the first direction.
Figure 11:
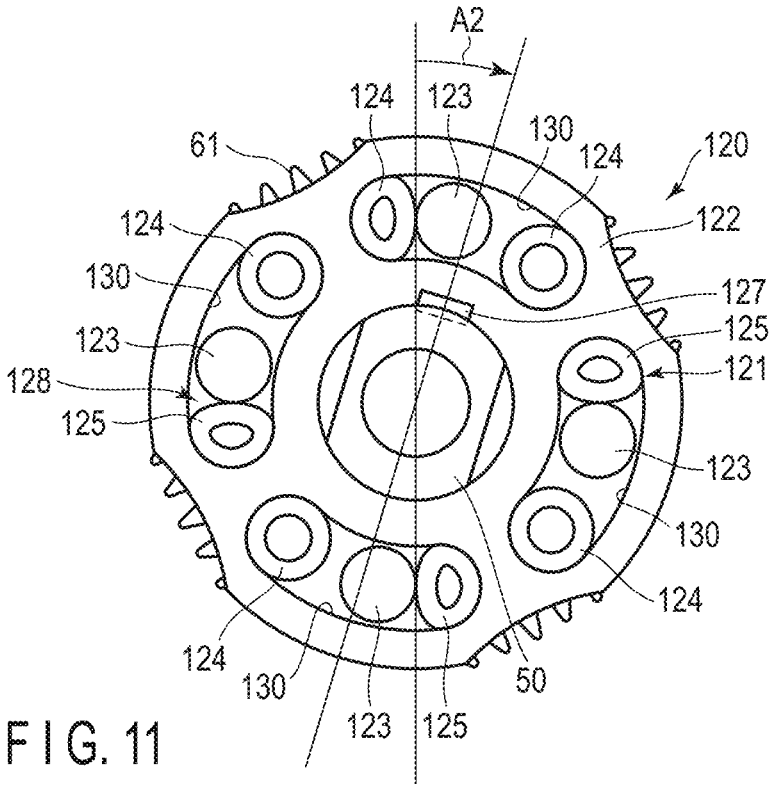
FIG. 11 is a front view showing a state where the driving side rotor of the force transmission mechanism shown in FIG. 9 rotates in the second direction.

FIG. 9 is a front view of the force transmission mechanism 120 including the damper unit 121. FIG. 10 is a front view showing a state where the driving side rotor 122 rotates in the first direction. FIG. 11 is a front view showing a state where the driving side rotor 122 rotates in the second direction.

The first elastic body 124 and the second elastic body 125 are formed of, for example, an elastomer or a rubber elastic body such as synthetic rubber. As shown in FIG. 8 to FIG. 11, the elastic bodies 124 and 125 are hollows, as an example. Depending on the need, the elastic bodies 124 and 125 may be solid. These elastic bodies 124 and 125 may be formed of elastic material. The elastic material deforms in a direction toward which the elastic material is compressed when a compressive load is applied and can also store energy to restore its shape.

Dumper accommodation holes 130, which are of the same number as the pins 123, are formed in the driving side rotor 122. As shown in FIG. 9, the elastic member 128 is accommodated in each of the dumper accommodation holes 130. The elastic member 128 is constituted by the first elastic body 124 and the second elastic body 125. The first elastic body 124 and the second elastic body 125 are arranged to sandwich the pin 123. The first elastic body 124 is arranged in the dumper accommodation hole 130 to be opposed to one side surface of the pin 123. The second elastic body 125 is arranged in the dumper accommodation hole 130 to be opposed to the other side surface of the pin 123. As another embodiment, the pin 123 may be provided on the driving side rotor 122 and the elastic member 128 may be provided on the output gear 61.

As shown in FIG. 5, an operator moves the lever member 27 from the neutral position N to the first direction A1 by a hand. Thus, torque of the first direction A1 is applied from the lever member 27 to the input shaft 50. As shown in FIG. 10, the first elastic body 124 is compressed by the pin 123 using torque applied in the first direction A1. That is, the first elastic body 124 deforms (decreasing its thickness) in a state where the input shaft 50 rotates in the first direction A1.

When the lever member 27 moves in the first direction A1 within the predetermined angle θ1 (shown in FIG. 5) in this manner, the first elastic body 124 is compressed by the pin 123. Thus, the input shaft 50 is allowed to rotate in a state where the output gear 61 stops. In other words, the input shaft 50 alone rotates in the first direction A1 without the output gear 61 moving.

When the lever member 27 moves by the first angle θ1 in the first direction A1, the potentiometer 51 outputs a signal (first signal) causing the motor 70 to rotate in the first rotational direction. This first signal causes the motor 70 to rotate in the first rotational direction. When the motor 70 rotates in the first rotational direction, the rotation is transmitted to the shift arm driving gear 100 via the reduction gear mechanism 110. Thus, the shift arm 85 moves to the forward-side shift position. In other words, the shift arm 85 is moved to the forward-side shift position by torque caused by the motor 70. An operator only has to put a hand on the shift arm 85. In some cases, an operator does not have to put a hand on the shift arm 85.

As shown in FIG. 5, when the lever member 27 moves to the forward-side position F1, the motor 70 stops based on the signal output from the potentiometer 51. The motor 70 stops to make the lever member 27 stop at the forward-side position F1. The shift arm 85 is held at the forward-side shift position by the detent mechanism 90.

As shown in FIG. 6, an operator moves the lever member 27 from the neutral position N to the second direction A2 by a hand. Thus, torque of the second direction A2 is applied from the lever member 27 to the input shaft 50. As shown in FIG. 11, the second elastic body 125 is compressed by the pin 123 using torque applied in the second direction A2. That is, the second elastic body 125 deforms (decreasing its thickness) in a state where the input shaft 50 rotates in the second direction A2.

When the lever member 27 moves in the second direction A2 within the predetermined second angle θ2 (shown in FIG. 6) in this manner, the second elastic body 125 deforms to allow the rotation of the input shaft 50 in a state where the output gear 61 stops. In other words, the input shaft 50 alone rotates in the second direction A2 without the output gear 61 moving.

When the lever member 27 moves by the second angle θ2 in the second direction A2, the potentiometer 51 outputs a signal (second signal) causing the motor 70 to rotate in the second rotational direction. This second signal causes the motor 70 to rotate in the second rotational direction. When the motor 70 rotates in the second rotational direction, the rotation is transmitted to the shift arm driving gear 100 via the reduction gear mechanism 110. Thus, the shift arm 85 moves to the backward-side shift position. In other words, the shift arm 85 is moved to the backward-side shift position by torque caused by the motor 70. An operator only has to put a hand on the shift arm 85. In some cases, an operator does not have to put a hand on the shift arm 85.

As shown in FIG. 6, when the lever member 27 moves to the backward-side position R1, the motor 70 stops based on the signal output by the potentiometer 51. The motor 70 stops to cause the lever member 27 to stop at the backward-side position R1. At this time, the shift arm 85 is held at the backward-side shift position by the detent mechanism 90.

During a neutral state, such as a case of idling a vehicle engine, in which shift operation is not conducted, the lever member 27 is urged to the neutral position N by elastic restoring force of the damper unit 121. In addition, the shift arm 85 is held at the neutral position by the detent mechanism 90. Therefore, the lever member 27 or the shift arm 85 can be prevented from unpredictably moving to the forward side or the backward side.

As described above, when an operator operates the lever member 27, the elastic bodies 124 and 125 of the damper unit 121 deform due to torque input to the lever member 27. The deformation of the elastic bodies 124 and 125 cause moderate reaction force on the lever member 27. When the lever member 27 moves to the predetermined angle θ1 in the forward side or the predetermined angle θ2 in the backward side against this reaction force, the motor 70 is actuated based on the output from the potentiometer 51. Therefore, start and stop of the motor 70 can be controlled based on the position of the lever member 27 without using the torque sensor.

In the engine control apparatus 30 of the present embodiment, an assist force based on torque of the motor 70 is added to operation force of the shift arm 85, when the shift arm 85 is operated. That is, the shift arm 85 can be switched to the forward-side shift position or the backward-side shift position by assist force of the motor 70. Thus, the shift operation can be easily performed by small force.

The motor 70 may become non-energized state due to unpredicted power supply trouble and the like. When the motor 70 becomes non-energized state, an operator manually moves the lever member 27 in the first direction A1 or the second direction A2. Thus, torque input to the lever member 27 is transmitted to the shift arm driving gear 100 via the output gear 61. For example, an operator moves the lever member 27 by more than the angle θ1 toward the forward-side position F1. In that case, the rotation of the input shaft 50 is transmitted to the output gear 61 through the first elastic body 124. For example, an operator moves the lever member 27 by more than the angle θ2 toward the backward-side position R1. In that case, the rotation of the input shaft 50 is transmitted to the output gear 61 through the second elastic body 125.

Therefore, even if the electrical outage occurs, the shift arm 85 can be forcibly driven by a hand. At this time, torque input to the lever member 27 is transmitted to the motor 70 via the reduction gear mechanism 110 and thus the motor 70 is driven to rotate.

Second Embodiment

Figure 12:
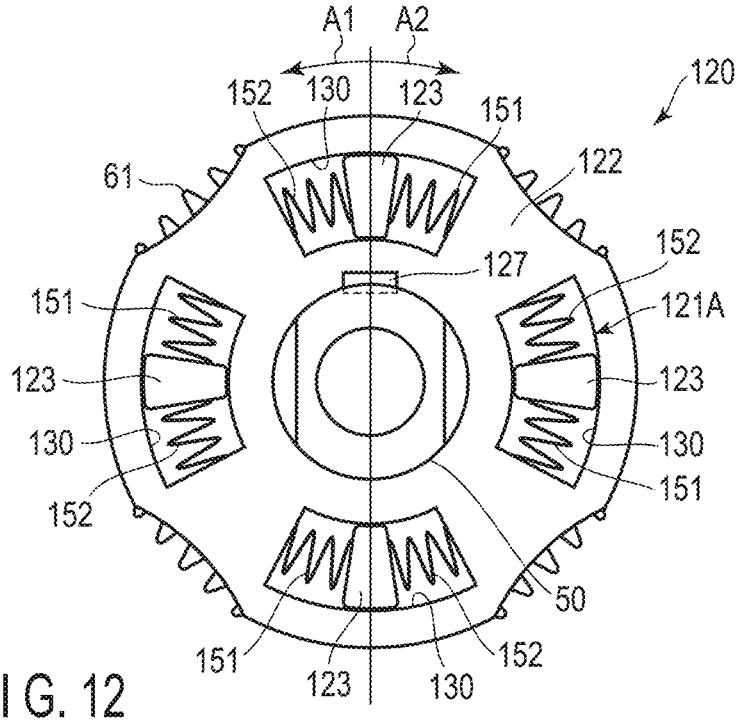
FIG. 12 is a front view showing a force transmission mechanism comprising a damper unit of a second embodiment.

FIG. 12 is a front view showing a force transmission mechanism 120 comprising a damper unit 121A of a second embodiment. The damper unit 121A comprises metal springs 151 and 152. The springs 151 and 152 are, for example, coil springs, disc springs, and the like. The spring 151 is opposed to a side surface of a pin 123. The spring 152 is opposed to the other side surface of the pin 123. An elastic member is constituted by the pair of springs 151 and 152.

When an input shaft 50 rotates in a first direction A1, the spring 151 is compressed by the pin 123. When the input shaft 50 rotates in a second direction A2, the spring 152 is compressed by the pin 123. The constituent elements other than the above are common to the damper unit 121 of the first embodiment (FIG. 9 to FIG. 11) and the damper unit 121A of the second embodiment. Common reference numbers are added to constituent elements which are common to those of the damper unit 121 of the first embodiment and the damper unit 121A of the second embodiment and explanations of those parts are omitted.

Third Embodiment

Figure 13:
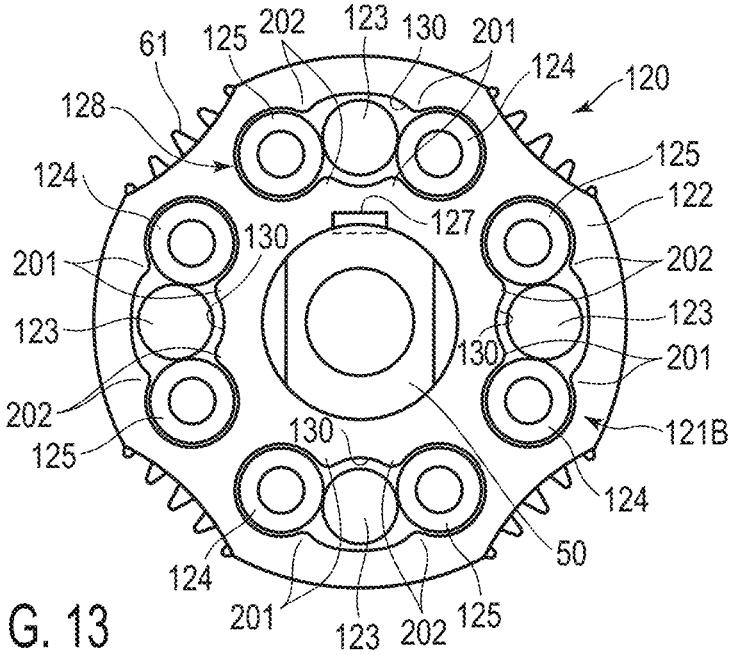
FIG. 13 is a front view showing a force transmission mechanism comprising a damper unit of a third embodiment.
Figure 14:
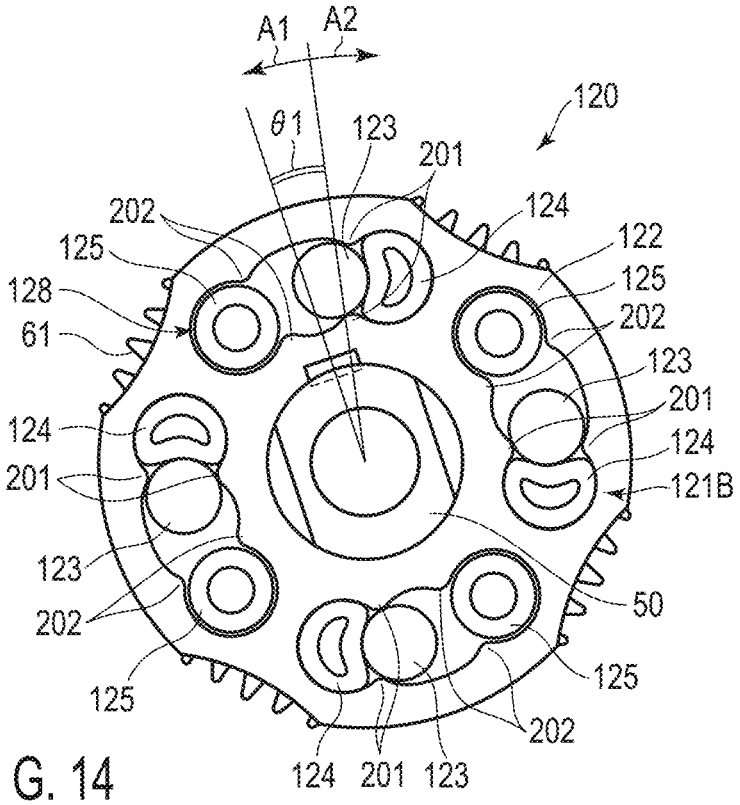
FIG. 14 is a front view showing a state where a driving side rotor of the force transmission mechanism shown in FIG. 13 rotates in a first direction.

FIG. 13 is a front view showing a force transmission mechanism 120 comprising a damper unit 121B of a third embodiment. FIG. 14 shows a state where a driving side rotor 122 of the damper unit 121B rotates in a first direction A1. This damper unit 121B includes a first stopper 201 and a second stopper 202. The first stopper 201 is formed between a pin 123 and a first elastic body 124. The second stopper 202 is formed between the pin 123 and a second elastic body 125. The constituent elements other than the above are common to the damper unit 121 of the first embodiment (FIG. 9 to FIG. 11) and the damper unit 121B of the third embodiment. Common reference numbers are added to constituent elements which are common to those of the damper unit 121 of the first embodiment and the damper unit 121B of the third embodiment and explanations of those parts will be omitted.

As shown in FIG. 14, the first elastic body 124 is compressed by the pin 123, when the driving side rotor 122 rotates in a first direction A1. At the same time, the pin 123 contacts the first stopper 201. Thus, the driving side rotor 122 is prevented from relatively rotating at a first angle θ1 or more with respect to the output gear 61 in the first direction A1. Thus, excessive compression of the first elastic body 124 can be suppressed. Therefore, the first elastic body 124 can be prevented from being broken, and the durability of the first elastic body 124 can be increased.

Contrary to the case shown in FIG. 14, when the driving side rotor 122 rotates in a second direction A2, the second elastic body 125 is pressed by the pin 123 to deform. At the same time, the pin 123 contacts the second stopper 202. Thus, the driving side rotor 122 is prevented from relatively rotating at a second angle or more with respect to the output gear 61 in the second direction A2. Thus, excessive compression of the second elastic body 125 can be suppressed. Therefore, the second elastic body 125 can be prevented from being broken, and the durability of the second elastic body 125 can be increased.

Fourth Embodiment

Figure 15:
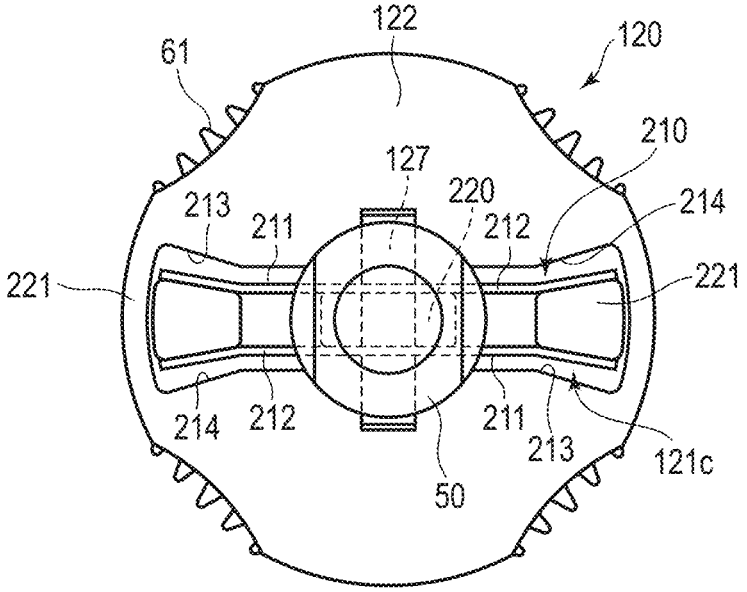
FIG. 15 is a front view showing a force transmission mechanism comprising a damper unit of a fourth embodiment.
Figure 16:
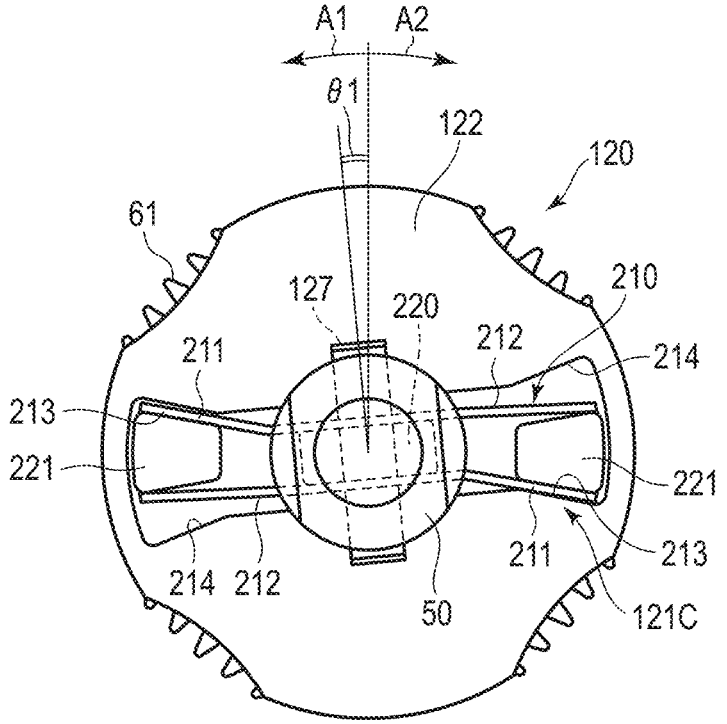
FIG. 16 is a front view showing a state where a driving side rotor of the force transmission mechanism shown in FIG. 15 rotates in a first direction.

FIG. 15 is a front view showing a force transmission mechanism 120 comprising a damper unit 121C of a fourth embodiment. FIG. 16 shows a state where a driving side rotor 122 of the damper unit 121C rotates in a first direction A1. This damper unit 121C includes a first plate spring 211, a second plate spring 212, a first stopper 213, and a second stopper 214. An elastic member 210 is constituted by the first plate spring 211 and the second plate spring 212. The first stopper 213 is opposed to the first plate spring 211. The second stopper 214 is opposed to the second plate spring 212.

The first plate spring 211 and the second plate spring 212 is fixed to the input shaft 50 by a fixing member 220 and a rotation prevention member 127. The driving side rotor 122 rotates together with the input shaft 50. Thus, the plate springs 211 and 212, the fixing member 220, and the rotation prevention member 127 rotate together with the driving side rotor 122. A pair of pins 221 are provided on an output gear 61. The pin 221 rotates together with the output gear 61. The constituent elements other than the above are common to the damper unit 121 of the first embodiment (FIG. 9 to FIG. 11) and the damper unit 121C of the fourth embodiment. Common reference numbers are added to constituent elements which are common to those of the damper unit 121 of the first embodiment and the damper unit 121C of the fourth embodiment and explanations of those parts will be omitted.

As shown in FIG. 16, the first plate spring 211 is pressed and bent by the pin 221, when the driving side rotor 122 rotates in the first direction A1. At the same time, the pin 221 contacts the first stopper 213. Thus, the driving side rotor 122 is prevented from relatively rotating at a first angle θ1 or more with respect to the output gear 61 in the first direction A1. Thus, excessive deformation of the first plate spring 211 can be suppressed. Therefore, the first plate spring 211 can be prevented from being broken, and the durability of the first plate spring 211 can be increased.

Contrary to the case shown in FIG. 16, when the driving side rotor 122 rotates in the second direction A2, the second plate spring 212 is pressed by the pin 221 to deform. At the same time, the pin 221 contacts the second stopper 214. Thus, the driving side rotor 122 is prevented from relatively rotating at a second angle or more with respect to the output gear 61 in the second direction A2. Thus, excessive deformation of the second plate spring 212 can be suppressed. Therefore, the second plate spring 212 can be prevented from being broken, and the durability of the second plate spring 212 can be increased.

Fifth Embodiment

Figure 17:
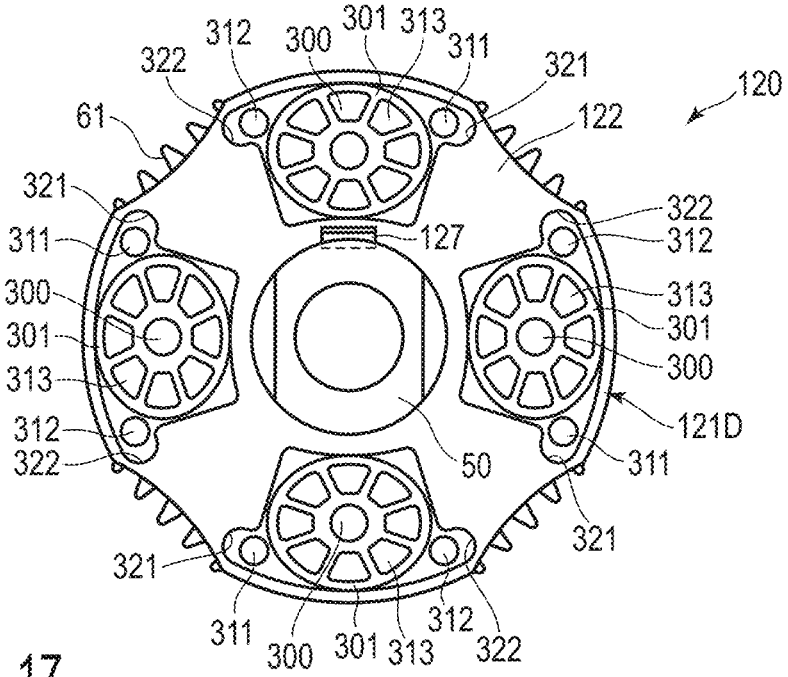
FIG. 17 is a front view showing a force transmission mechanism comprising a damper unit of a fifth embodiment.
Figure 18:
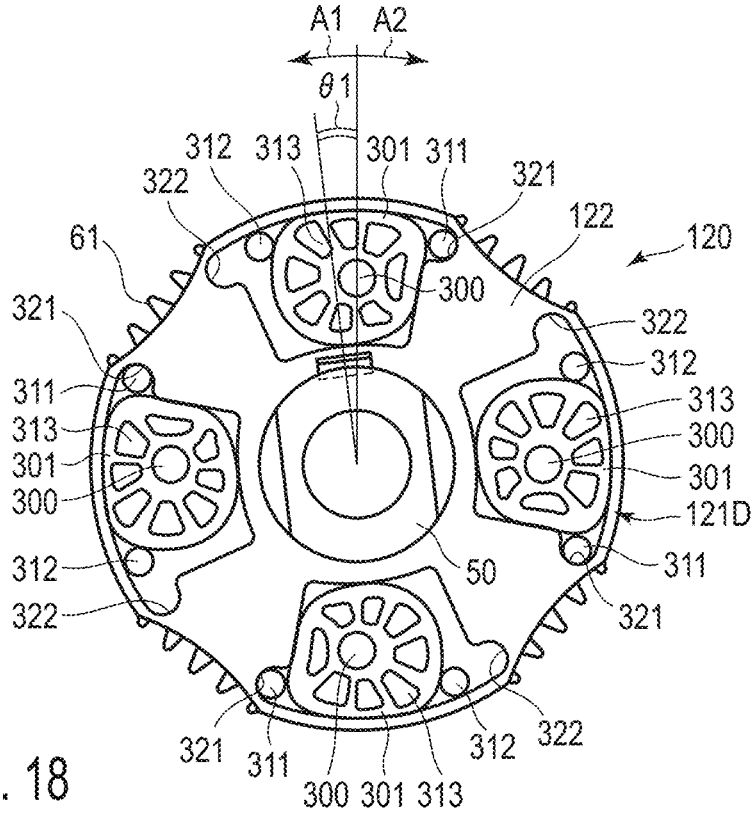
FIG. 18 is a front view showing a state where a driving side rotor of the force transmission mechanism shown in FIG. 17 rotates in a first direction.

FIG. 17 is a front view showing a force transmission mechanism 120 comprising a damper unit 121D of a fifth embodiment. FIG. 18 shows a state where a driving side rotor 122 of the damper unit 121D rotates in a first direction A1. This damper unit 121D includes a plurality of (for example, four) pins 300, a wheel-shaped elastic member 301, a first stopper 311, and a second stopper 312. The pin 300 is provided on an output gear 61. The elastic member 301 is supported by the pin 300. The first stopper 311 is provided on the output gear 61. The first stopper 311 is opposed to one side of an elastic member 301. The second stopper 312 is provided on the output gear 61. The second stopper 312 is opposed to the other side of the elastic member 301. A plurality of holes 313 are formed around the pin 300 of the elastic member 301.

The driving side rotor 122 includes a first suppression wall 321 and a second suppression wall 322. The first suppression wall 321 is formed on a position corresponding to the first stopper 311. The second suppression wall 322 is formed on a position corresponding to the second stopper 312. The constituent elements other than the above are common to the damper unit 121 of the first embodiment (FIG. 9 to FIG. 11) and the damper unit 121D of the fifth embodiment. Common reference numbers are added to constituent elements which are common to those of the damper unit 121 of the first embodiment and the damper unit 121D of the fifth embodiment and explanations of those parts will be omitted.

As shown in FIG. 18, when the driving side rotor 122 rotates in a first direction A1, the elastic member 301 is compressed between the pin 300 and the driving side rotor 122 to deform. The first stopper 311 contacts the first suppression wall 321 in a state where the elastic member 301 is compressed. Thus, the driving side rotor 122 is prevented from relatively rotating at a first angle θ1 or more with respect to the output gear 61 in the first direction A1. Thus, excessive compression of the first elastic member 301 can be suppressed. Therefore, the first elastic member 301 can be prevented from being broken, and the durability of the elastic member 301 can be increased.

Contrary to the case shown in FIG. 18, when the driving side rotor 122 rotates in the second direction A2, the elastic member 301 is pressed between the driving side rotor 122 and the pin 300 to deform. The second stopper 312 contacts the second suppression wall 322 in a state where the elastic member 301 is compressed. Thus, the driving side rotor 122 is prevented from relatively rotating at a second angle or more with respect to the output gear 61 in a second direction A2. Thus, excessive compression of the elastic member 301 can be suppressed. Therefore, the elastic member 301 can be prevented from being broken, and the durability of the elastic member 301 can be increased.

In all of the plurality of damper units 121, and 121A to 121D according to the embodiments, pins are provided on the output gear 61 and an elastic member is provided on the driving side rotor 122. Further, as another embodiment, a pin may be provided on the driving side rotor 122 and an elastic member may be provided on the output gear 61.

Needless to say, when carrying out the present invention, each of the elements constituting the engine control apparatus may be modified variously. The engine control apparatus of the present invention may be provided on structures other than the tiller handle of the outboard motor (for example, a hull, a cabin, and the like). The present invention may also be applied to an engine control apparatus for remotely operating machines other than the outboard motor.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An engine control apparatus, comprising:

a base member;

a lever member rotating about an input shaft provided on the base member, the lever member moving from a neutral position in a first direction and a second direction;

an output gear provided on the input shaft, the output gear being capable of relatively rotating about the input shaft;

a motor arranged on the base member, the motor rotating in a first rotational direction and a second rotational direction;

a potentiometer outputting a signal causing the motor to rotate in the first rotational direction in a state where the lever member moves in the first direction, the potentiometer outputting a signal causing the motor to rotate in the second rotational direction in a state where the lever member moves in the second direction;

a shift arm rotating about a shift arm shaft provided on the base member, a shift cable being connected to the shift arm;

a shift arm driving gear provided on the shift arm shaft, the shift arm driving gear engaging with the output gear;

a reduction gear mechanism transmitting rotation of the motor to the shift arm driving gear; and a force transmission mechanism including a damper unit provided between the input shaft and the output gear, the force transmission mechanism allowing the input shaft to rotate in a state where the output gear stops by the damper unit deforming, when the lever member is located within a predetermined angle from the neutral position, and transmitting the rotation of the input shaft to the output gear via the damper unit, when the lever member has an angle more than the predetermined angle.

2. The engine control apparatus of claim 1, wherein the damper unit includes:

a driving side rotor rotating together with the input shaft;

a pin provided on the output gear or the driving side rotor; and an elastic member being pressed by the pin to deform in a state where the input shaft rotates in a first direction and being pressed by the pin to deform in a state where the input shaft rotates in a second direction.

3. The engine control apparatus of claim 2, wherein the damper unit includes:

a first stopper preventing the driving side rotor from relatively rotating at a first angle or more with respect to the output gear in a state where the driving side rotor rotates in the first direction and the elastic member deforms; and a second stopper preventing the driving side rotor from relatively rotating at a second angle or more with respect to the output gear in a state where the driving side rotor rotates in the second direction and the elastic member deforms.

4. The engine control apparatus of claim 2, wherein the elastic member includes:

a first elastic body arranged to be opposed to a side surface of the pin, first elastic body being compressed by the pin in a state where the input shaft rotates in the first direction; and a second elastic body arranged to be opposed to another side surface of the pin, the second elastic body being compressed by the pin in a state where the input shaft rotates in the second direction.

5. The engine control apparatus of claim 1, wherein the reduction gear mechanism is constituted by a plurality of spur gears, and in a state where the motor is in non-energized state, when torque input to the input shaft from the lever member is transmitted to the output gear and the shift arm driving gear via the force transmission mechanism, the shift arm is rotated by the torque and the motor is driven to rotate by the torque transmitted to the motor via the reduction gear mechanism.

6. The engine control apparatus of claim 1, wherein the engine control apparatus is provided on a tiller handle of an outboard motor, and the shift cable is connected to a shift mechanism of the outboard motor.

* * * * *